United States Patent [19]

Eckert, Jr. et al.

[11] 4,259,902

[45] Apr. 7, 1981

[54] ELECTRONIC POSTAGE METER WITH POWER FAILURE ACCOUNTING PROTECTION SYSTEM

[75] Inventors: Alton B. Eckert, Jr., Norwalk; Lynnwood Lowe, Darien; Robert B. McFiggans, Stamford, all of Conn.

[73] Assignee: Pitney Bowes Inc., Stamford, Conn.

[21] Appl. No.: 89,423

[22] Filed: Oct. 30, 1979

[51] Int. Cl.[3] ..... B41J 1/22; G07B 17/02

[52] U.S. Cl. ..... 101/91; 101/110

[58] Field of Search ..... 101/91, 45, 92, 110, 101/95-98, 99, 235; 235/60 P, 101, 58 P, 130 R; 440/663-667, 676-678

[56] References Cited

U.S. PATENT DOCUMENTS

| | | | |
|---|---|---|---|
| 2,934,009 | 4/1960 | Bach et al. | 101/235 |
| 3,938,095 | 2/1976 | Check, Jr. et al. | 340/172.5 |
| 3,978,457 | 8/1976 | Check, Jr. et al. | 340/172.5 |
| 4,007,359 | 2/1977 | Ford | 235/101 |
| 4,050,374 | 9/1977 | Check, Jr. | 101/91 |
| 4,160,899 | 7/1979 | Montagnino et al. | 235/60 P |
| 4,202,489 | 5/1980 | Schubert | 235/101 |

*Primary Examiner*—J. Reed Fisher

*Attorney, Agent, or Firm*—David E. Pitchenik; William B. Soltow, Jr.; Albert W. Scribner

[57] ABSTRACT

A postal meter includes a postal meter assembly adapted to be driven from a base, for in turn driving the drum of a settable printing mechanism. The meter has an electronic accounting system with a register, and means setting the register during the printing cycle. A mechanical latch is positioned to stop rotation of the gear assembly at a home position if an electronic accounting has not occurred during the previous printing cycle. The gear assembly further includes a cam surface for driving the mechanical latch to this position following initiation of a printing cycle. A detent has a tooth selectively engageable with a pair of notches on the lever corresponding to the two lever positions, the detent being displaced in one case by a cam surface of the gear assembly and in the second case by a lever system responsive to the operation of the accounting system.

11 Claims, 6 Drawing Figures

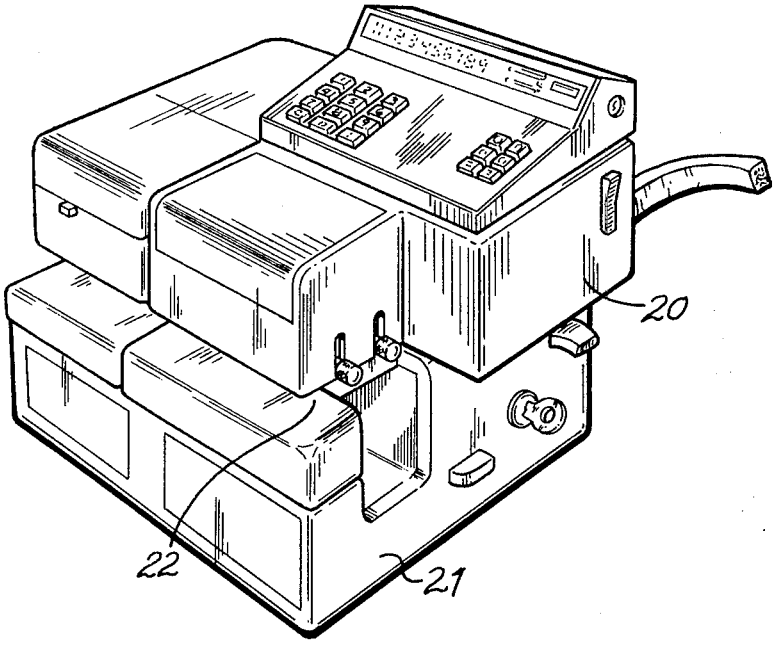
Fig. 1
Fig. 6
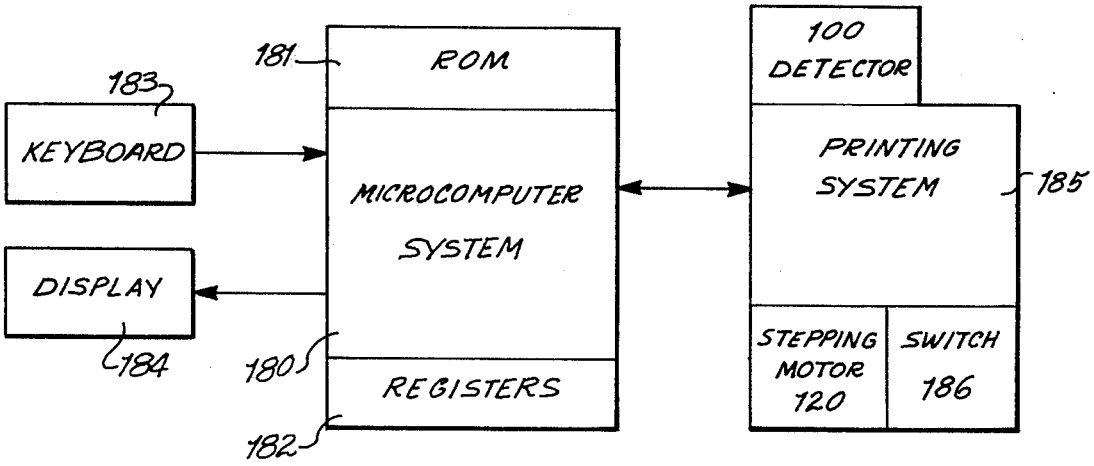

ELECTRONIC POSTAGE METER WITH POWER FAILURE ACCOUNTING PROTECTION SYSTEM

BACKGROUND OF THE INVENTION

This invention relates to electronic postage meters, wherein the meter includes a printing mechanism and at least one electronic register for registering a value corresponding to the setting of printing wheels of the printing mechanism. The invention is particularly concerned with this type of a postage meter, wherein the drive for the meter is obtained from the mechanical drive energy of a postal meter base, from which the postal meter itself may be removed by the operator.

In postage meter systems of one type, a postage meter is provided that is separable from a "drive base". In this type of system, as exemplified in known equipment by the Model 5300 postage meter manufactured by Pitney Bowes, Inc. of Stamford, Connecticut, and meter base Models 5460 and 5600 also manufactured by Pitney Bowes, Inc. of Stamford, Conn., the base incorporates means for driving the mechanical printing mechanism of the postage meter. A base for use in such a system is also disclosed in U.S. Pat. No. 2,934,009, Bach, et al.

In known equipment of the above type operating with primarily mechanical means, the postage meter is provided with a printing drum which may incorporate either fixed or settable postage type. The drum is driven internally of the postage meter by a drive gear, the drive gear being adapted to be coupled to a driving gear in the base when the two units are intercoupled. The postage meter further incorporates a shutter bar adapted to be mechanically intercoupled to a shutter lever on the base when two units are connected together. The shutter bar, or mechanical means coupled thereto, engage and prevent rotation of the drive gear, so that the printing of postage cannot be effective when the shutter is in its closed position. A shutter lever is provided on the driving base, for engaging the shutter bar or mechanical elements coupled thereto, to effect the movement of the shutter bar to its open position upon the initiation of a print cycle by suitable tripping means in the base. If the shutter bar of the postage meter is free to move, the shutter lever may thereby move the shutter bar out of locking engagement with the drive gear. The drive base further incorporates a clutch operative by the shutter lever so that the driving gear in the base may be driven, to in turn drive the drive gear in the postage meter, only if the shutter bar is capable of being moved to its open position. The postage meter further incorporates various blocking, or interposing means, which prevent the opening of the shutter bar in the event of certain conditions, for example, the absence of adequate postage available as stored in a mechanical register in the postage meter itself, or the mounting of the meter on an improper base.

In systems of this type, the base need not be secure, and may be a device sold as a retail item. The postage meter itself, however, is mechanically secure, i.e., it is enclosed in a secure housing so that the critical accounting and printing equipment cannot be tampered with, without rendering such tampering obvious to postal authorities.

In a primary mechanical system of the above type, postage accounting registers in the postage meter are generally of a mechanical nature, so that conditions cannot normally occur that would prevent the registration of any printing cycle to effect the storage of data corresponding to all postage that has been printed.

With the advent of economical electronic control systems, especially microcomputer systems, it is feasible to incorporate electronic accounting devices within the postage meter. Such electronic devices provide certain advantages, such as more rapid accounting of postage, to enable the use of the postage meters in high speed equipment. The electronic devices also may be more economically produced on a mass production basis, and minimize the weight, size and cost of production of the postage meter devices. Further, the provision of electronic accounting means within the postage meter renders the meter capable of additional functions that were not readily achievable in the primarily mechanical devices.

Electronic postage meters of the above type are disclosed, for example, in U.S. Pat. Nos. 3,938,095, Check, Jr., et al and 3,978,457, Check, Jr., et al.

Certain difficulties may arise in the use of an electronically accounting postage meter in combination with a base of the above described type. Thus, a problem can arise from the fact that, if a power source to the accounting registers is accidentally or intentionally removed as soon as the printing cycle has been initiated and the shutter bar has moved to release the postage meter drive, the printing cycle may be completed, but the postage printed may not be accounted since the electronic registers are unpowered.

SUMMARY OF THE INVENTION

The present invention is therefore directed to an improved postage meter of the type having:

1. An electronic accounting means or, more broadly, an accounting means dependent upon the proper application of an electric operating voltage or current, for its operation;
2. A printing mechanism;
3. An input for receiving driving energy for the printing mechanism, preferably but not limited to mechanical driving energy; and
4. Intercoupling between the accounting means and the printing mechanism or driving energy input system for effecting the registration of postage some time following the initiation of the printing cycle. While means may be provided in the above described type of postage meter to ensure that the drive for the printing drum is locked out at any time that the electrical power for the counting system is lost, or is inadequate for effecting registration of printed postage, in order to overcome at least a part of the problem, on some occasions this would not be satisfactory if, under determined circumstances, it is desired to complete any printing cycle that has already been initiated.

The invention therefore is directed to a postage meter of the above type wherein means are provided for enabling the completion of printing cycles that have already commenced, even though the printing data cannot properly be registered in the accounting means due, for example, to the loss of electric operating voltage or current, and wherein the missed accounting operations will be ensured upon the restoration of power.

In accordance with the invention, the problems involved in the provision of the former solution may be overcome by providing an arrangement wherein a postage cycle, once initiated, will be continued to completion under the driving power of the base, but unaccounted postage printing is stored, for example by mechanical means such as a bistable or multistable mechanical element, so that the occurrence of one or more unaccounted printing cycles may be detected and registered upon the return of the equipment to operative conditions.

Briefly stated, in accordance with the invention, a mechanical latch is provided, having a first position wherein drive input to the postage meter is inhibited from being transmitted to the printing mechanism, at the initiation of a printing cycle. This position of the mechanical latch is operative, however, only if the state exists at the time of initiation of a printing cycle by the printing base, i.e., the operation of the tripping lever in the base. The mechanical latch is set to this position by the drive input itself, such as a driving gear assembly in the postage meter, shortly following the actual start of the printing cycle, i.e., when the printing cycle has unconditionally commenced. The mechanical latch has a further setting which does not interfere with the initiation of the printing cycle. This state is obtained in response to the actual accounting in the electronic accounting system of values corresponding to the setting of the print wheels during a given cycle.

The mechanical latch is preferably in the form of a lever having two positions, as above described, and a dentent having a tooth engageable selectively with a pair of notches in the lever for holding the lever in each of the two positions. The detent is positively urged by a cam on the drive input assembly for setting the lever to the locking condition, and a further lever system is provided operative in response to the operation of the accounting system for releasing the detent to enable spring means to set the latch to its own lock position. A single system may be provided that enables accounting to be effective only once a printing cycle has been irreversibly commenced and the lever may be set to its unlocking position to insure that all accounting operations are properly timed.

In the system of the invention, if power has been lost during a printing cycle prior to an accounting operation, the printing cycle will continue, but further printing cycles cannot be initiated. Upon restoration of the power to the accounting system, the failure to account is indicated by the position of the latch, whereby the accounting will then be automatically taken care of and the latch released for continued operation.

BRIEF FIGURE DESCRIPTION

In order that the invention will be more clearly understood, it will now be disclosed in greater detail with reference to the accompanying drawings, wherein:

FIG. 1 is a perspective view of an electronic postal meter mounted on a postal meter base, the electronic postal meter being of the type which may incorporate the system of the invention;

FIG. 6 is a simplified block diagram of the electronic system of a postal meter in accordance with the invention.

DETAILED DISCLOSURE OF THE INVENTION

Figure 2:
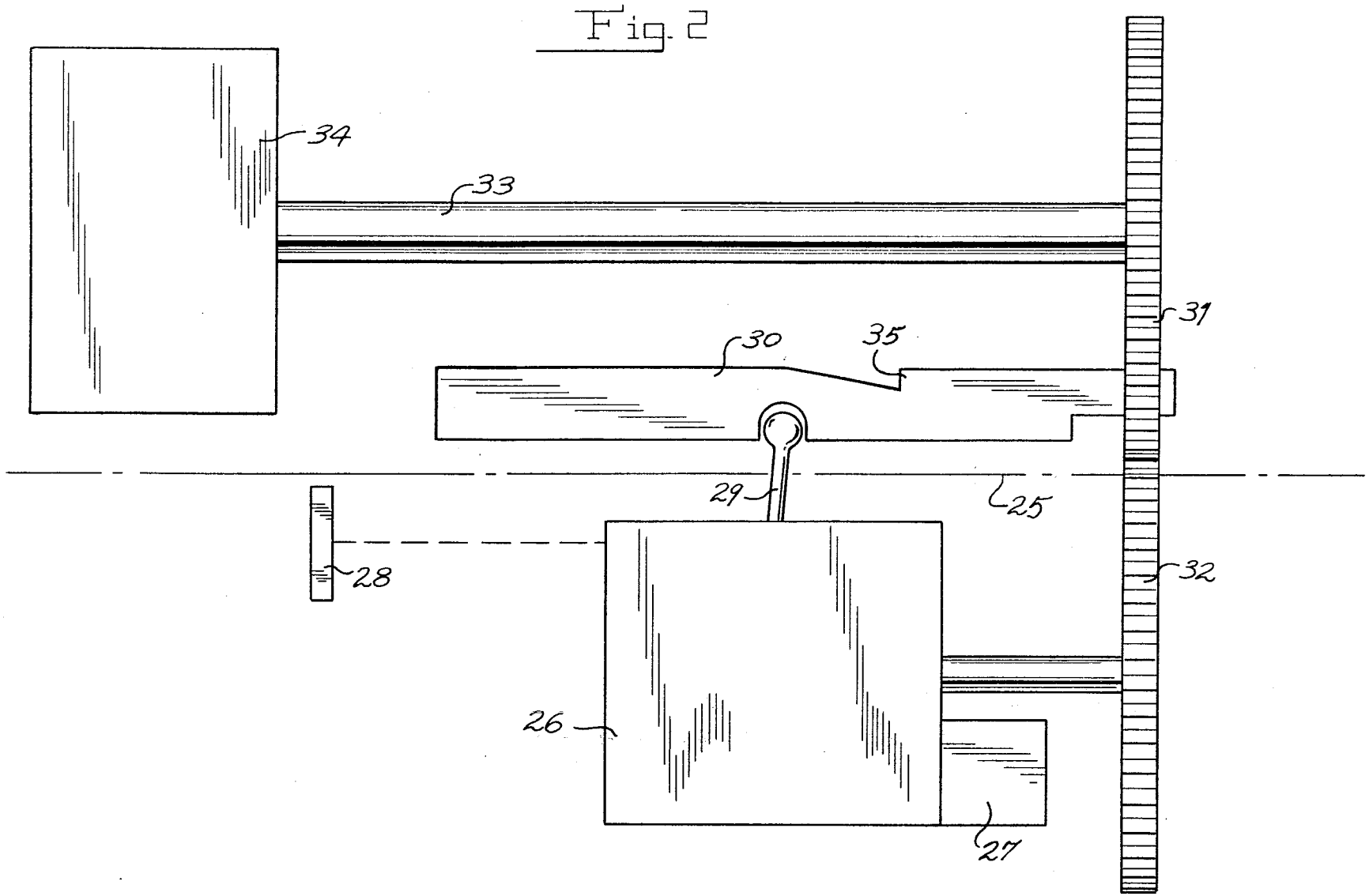
FIG. 2 is a simplified sketch of the driving elements of a postal meter of the type to which the present invention is directed.

Referring now to the drawings, and more in particular to FIG. 1, therein is illustrated one form of a postal meter system of the type to which the present invention is concerned. In this arrangement, the postal meter 20 itself is releasably affixed to a base unit 21, so as to form a letter slot 22 therebetween at the front edge of the assembly. The base unit 21 may be mechanically of the type disclosed, for example, in U.S. Pat. No. 2,934,009, Bach, et al, incorporating a mechanical drive (not seen in FIG. 1) for providing mechanical driving energy for the printing drum of the meter 20. In accordance with the invention, the postal meter 20 itself is an electronic postal meter, in the sense that the accounting system within the meter, including the registers, is electronic as opposed to mechanical. Electronic postage meters of this type are disclosed generally in U.S. Pat. No. 3,938,095, Check, Jr., et al and U.S. Pat. No. 3,978,457, Check, Jr., et al.

FIG. 2 illustrates in simplified form the cooperative relationship between a postal meter and a meter base. In this figure, the meter base is depicted generally below the dash-dot line 25, and may incorporate a control unit 26 driven by a motor 27. The unit further includes a trip finger 28 positioned to engage mail inserted in the system, for initiating operating cycles of the equipment, whereby the control unit 26 initially drives a shutter lever 29 to the left. The shutter lever 29 of the base unit engages a shutter bar 30 in the postal meter itself, so as to urge this bar leftward and out of locking engagement with a driven gear 31 also in the postal meter. If the system, during an operation cycle, is otherwise enabled to print postage, the shutter bar 30 will be free to be so driven, and will not impede the full leftward movement of the shutter lever 29. Clutch means within the control system 26 of the base will thereby enable the base to rotate the drive gear 32 through a full rotation. Since the postal meter is positioned with the driven gear 31 engaging the drive gear 32, the driven gear 31 of the postal meter will thereby be free to effect a single rotation of the drum shaft 33 of the postal meter, and hence of the printing drum 34. The orientation of elements depicted in FIG. 2 is generally known in the prior art, as discussed above, as well as in copending U.S. application Ser. No. 024,812 filed Mar. 28, 1979 and assigned to the assignee of the present invention.

In the arrangement of FIG. 2, assuming that a conventional mechanical accounting system (not shown) is coupled, for example, to the drum shaft 33, the positive mechanical drive will insure that the accounting registers have been brought up to date upon each termination of a printing cycle, since a portion of the energy of the driving gear 32 is expended for this purpose. This is no longer true, however, when an electronic accounting system is employed, since power may be intentionally or accidentally removed from the electronic accounting system following the initiation of a printing cycle and the withdrawal of the shutter bar 30 from interlocking engagements with the gear 31, but prior to the actual registering of the amount to be printed in the register. While it is possible in an electronic accounting system to inhibit withdrawal of the shutter 30 from interlocking engagement with the gear 31, for example, by means of an interposing solenoid element (not shown) with a notch 35 of the shutter bar, this does not provide a complete solution to the problem, since such interposer must normally be withdrawn to await a print cycle being initiated by the mailing machine. If power were to fail just as the shutter moves forward, the interposer might not fall in time to block rotation, and a printing would go unaccounted for. Similarly, it is not adequate to simply account when the shutter is observed to move forward, since there is no assurance that this will result in printing, therefore, it might result in accounting of sums that were not actually printed.

In accordance with the present invention, this problem may be overcome, in simple terms, by providing a latching system that is unconditionally set by the mechanical drum rotation of the printing device, and can be reset only by action initiated by the accounting electronics.

Figure 3:
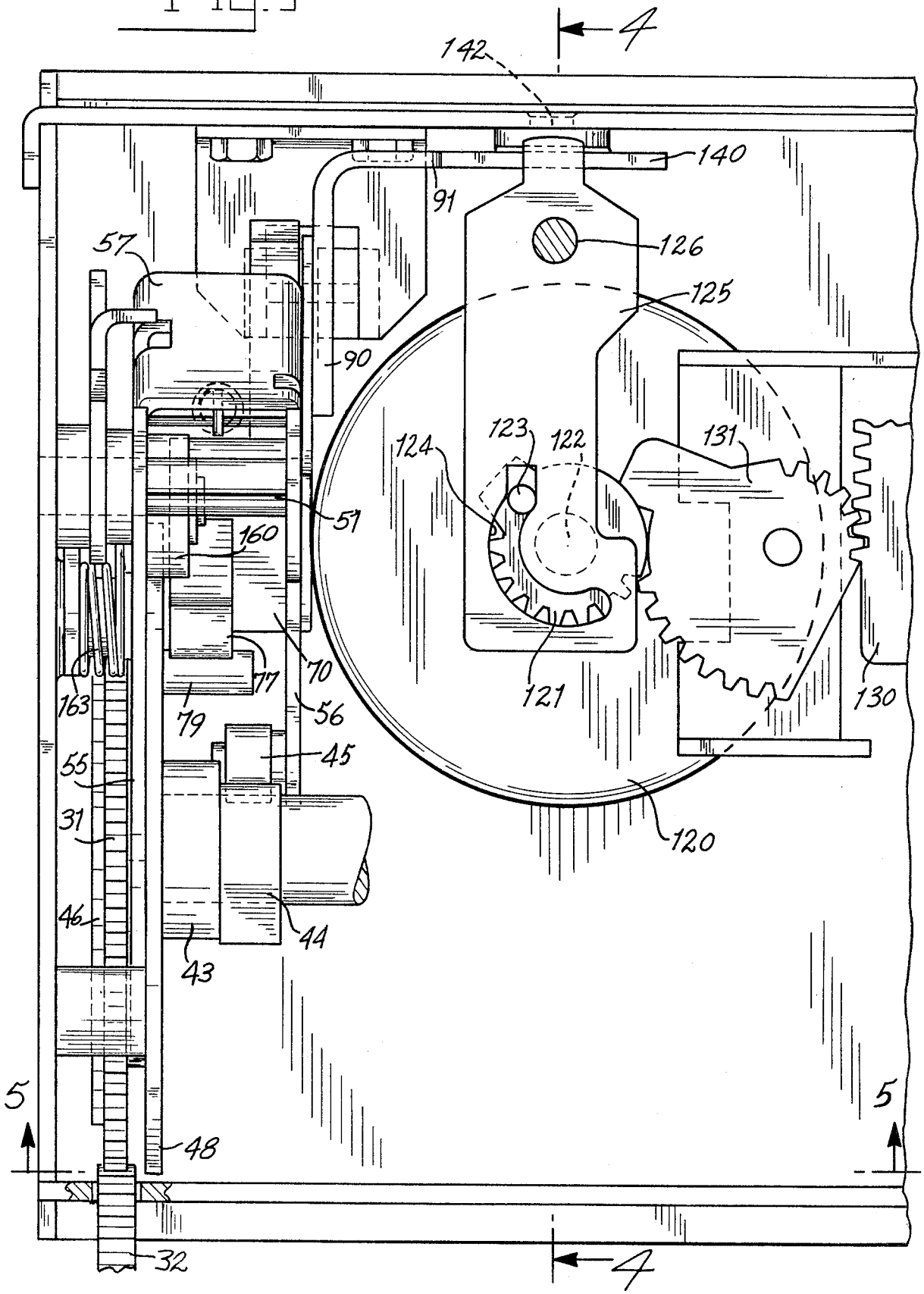
FIG. 3 is a partially cross-sectional view of a portion of the drive assembly of a postal meter incorporating the latching system of the invention.
Figure 4:
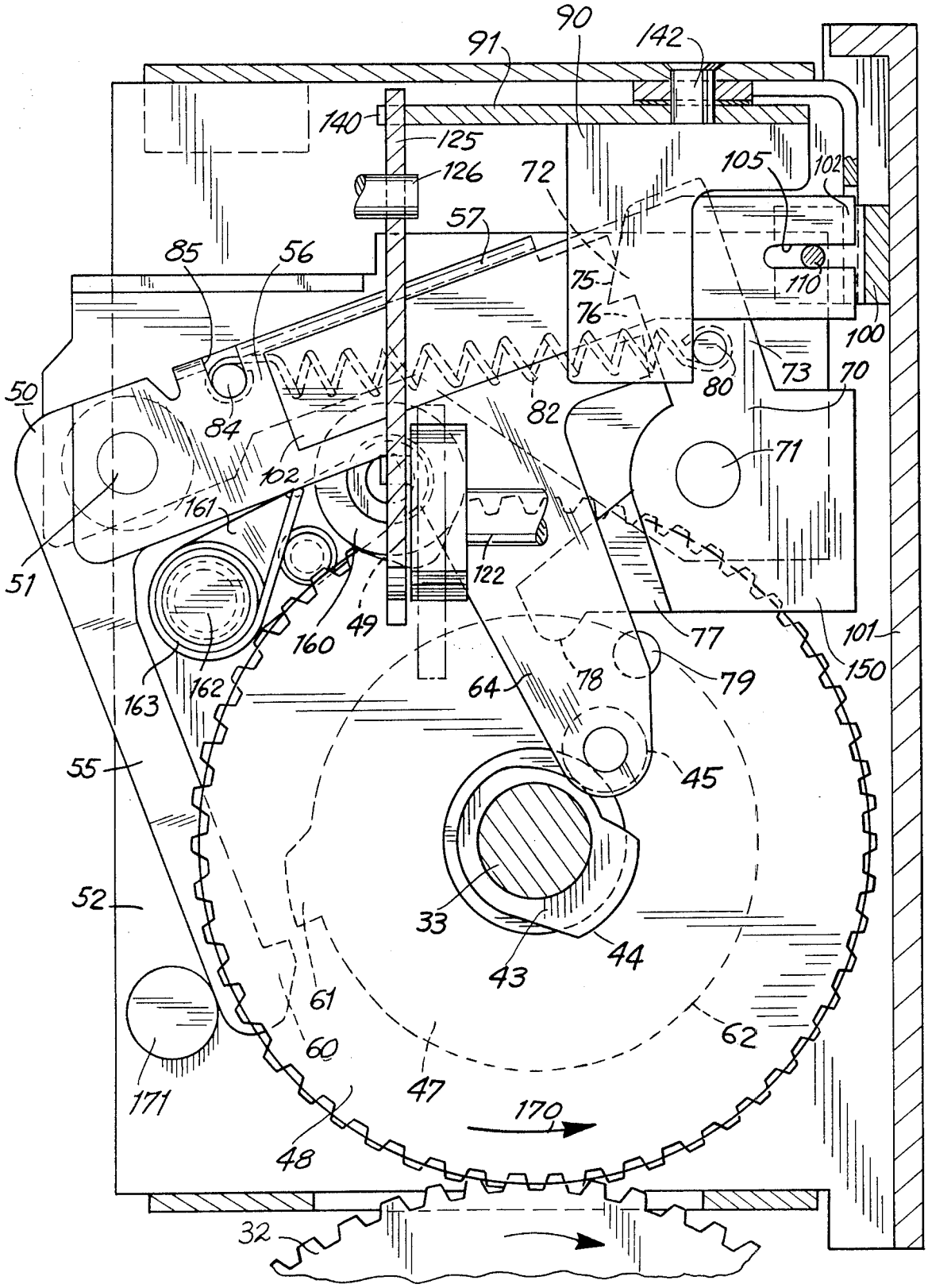
FIG. 4 is a cross-sectional view of the arrangement of FIG. 3, taken along the lines 4—4.
Figure 5:
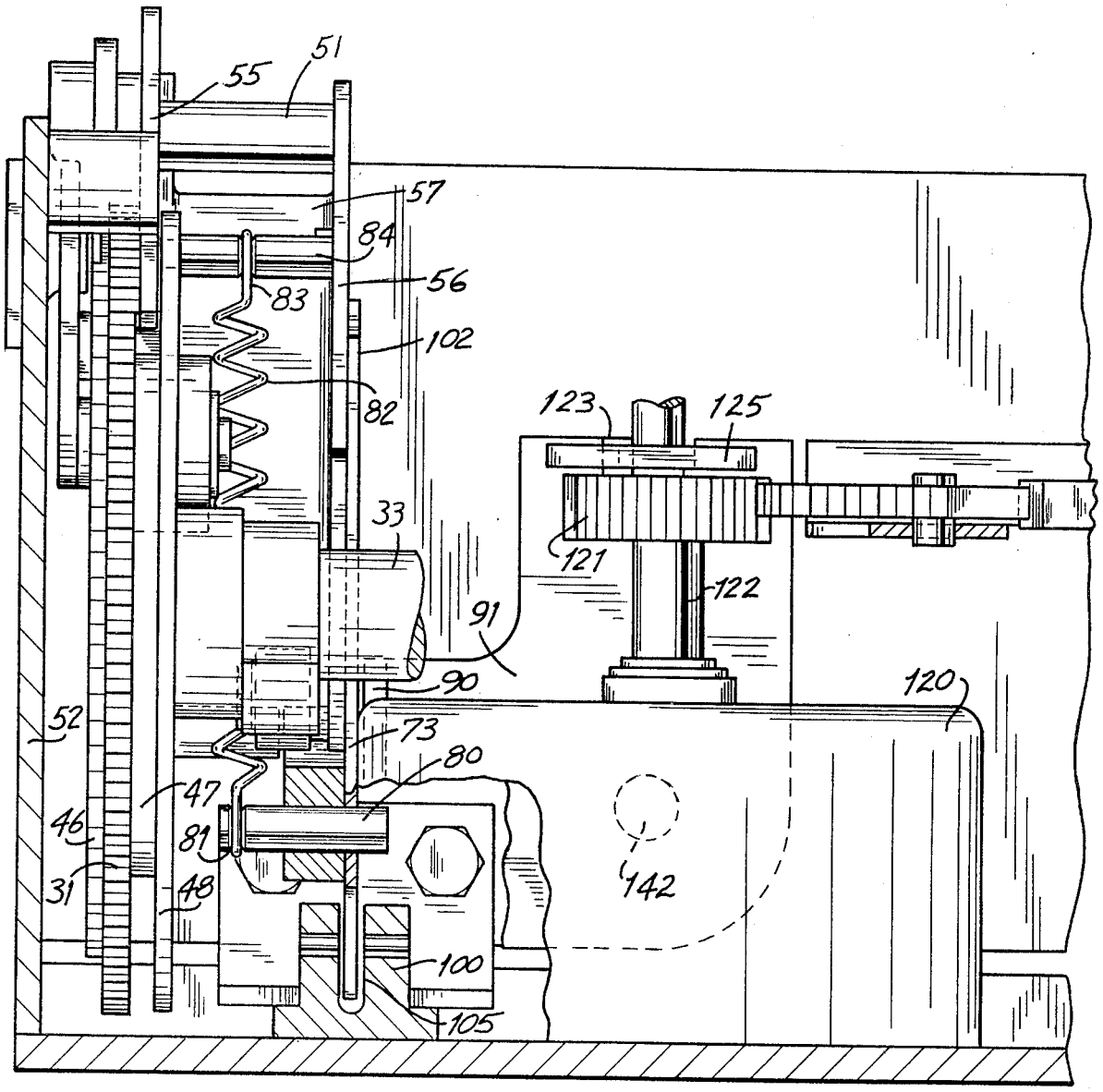
FIG. 5 is a bottom view of the arrangement of FIG. 3, taken along the lines 5—5.

Referring now to the detailed drawings of FIGS. 3–5, the driving gear 31 is adapted to be coupled to an external driving device, such device, such as the drive gear 32 of a postal meter drive base, for the supply of mechanical energy to the postal meter in the rotation of the printing drum during a printing cycle. The drive cycle 31 has a hub 43 with the end thereof formed with a cam surface 44 engaging a roller 45 to be discussed in greater detail in the following paragraphs. The hub 43 is mounted on the drum shaft 33 of the postal meter, for driving the drum 34 (FIG. 1) in the conventional manner. A ratchet gear 46 (FIG. 3) may be provided affixed to one side of the driving gear 31, for engaging a ratchet (not shown) in order to inhibit reverse rotation of the driving gear 31. A spacer cam 47 is provided on the other side of the drive gear, for rotation therewith, this spacer cam being adapted to cooperate with a latch as will be discussed in greater detail in the following paragraphs. A home position cam 48 (FIG. 4) is also mounted on the driving gear assembly, for example, on the other surface of the cam 47. The cam 48 has a notch 49 engaged by a roller 160 in the home position, the roller 160 being mounted on a lever 161 pivoted at axis 162, and being spring biased toward the notch by spring 163.

In order to enable latching of the drive gear assembly to inhibit the rotation of the drum shaft in the event of failure of power in the electronic circuitry of the postal meter, a latch generally indicated by the reference numeral 50 is pivotally mounted for rotation on a fixed pin 51, extending from the frame 52, the latch 50 being held on this pin by conventional means. The latch 50, as shown in FIG. 3, is generally U-shaped having one arm 55 extending generally in the plane of the cam 47, and another arm 56 extending generally adjacent the free end of the hub 43. The arms 55 and 56 are joined by a bridge 57 which more clearly appears in FIGS. 3 and 4.

With this orientation of elements, the shape and function of the latch 50 can be more clearly seen in FIG. 4. Therein is shown the arm 55 having a lug 60 engageable with a projection 61 on the cam surface 62 of the cam 47. As shown in FIG. 4, the other arm 56 of the latch extends generally from the pivotal axis normal to the arm 55, and has an extension 64 which carries the roller 45. As discussed above, the roller 45 cooperates with the cam surface portion 44 of the hub of the gear assembly.

As shown in FIG. 4, a detent 70 is pivoted on a fixed pin 71. The detent 70 has a tooth 72 depending from an arm 73 thereof, for engaging either of a pair of notches 75 or 76 in the end of the arm 56 of the latch. One end 77 of the detent is laterally displaced, and as shown in FIG. 4, carries a projection 78 positioned to engage a stud 79 mounted on the home position detent wheel 48 of the gear assembly. A pin 80 extends through the extension 73 of the detent, and has an annular notch 81 on one end for receiving a helical spring 82. The spring 82 extends to an annular notch 83 in a pin 84 held in aligned apertures 85 (FIG. 4) in the arms 55 and 56 of the latch. The spring holding pins 80 and 84 are positioned so as to continuously urge the tooth 72 of the detent 70 into engagement with one of the notches 75 or 76. It will be noted here that the pin 80 also extends from the other side of the detent 70, to form a release projection for the detent. This portion of the pin 80 is thus placed to be engageable by an arm 90 of a pivoted member 91, which is controlled in response to the electronic system of the postage meter as will be disclosed in greater detail in the following paragraphs.

The position of the latch 50 is detectable by the provision of a slotted electro-optic coupler 100 fixedly mounted within the postage meter on wall 101. A sheet metal plate 102 has a slot 105 therein. This plate 102 is affixed, as by spot welding or the like to the side of the arm 56 of the latch, so that in one position of the latch the plate 102 blocks the light path 110 in the electro-optic coupler and in the other position of the latch (as seen in FIG. 4), the slot 105 of the plate 102 is moved to a position to permit light from one arm of the electro-optic coupler to be received by the light detector in the other arm thereof. This electro-optic coupler is of conventional design.

U.S. Pat. No. 4,050,374 discloses a postage meter wherein a plurality of print wheels are provided in a rotatable print drum, the setting of the individual print wheel being controllable by separate setting gears. In this arrangement, a gear for sequentially controlling the setting gears is mounted on a splined shaft of a print wheel setting stepping motor, the main or control gear being movable by means of a yoke to separately engage the setting gears. In this arrangement the yoke carries locking teeth positioned to engage the teeth of the setting gears which are not currently being set, and to consequently block all of the setting gears at a determined home position of the assembly. The movement of the yoke, in order to effect sequential setting of the setting gears, is obtained by means of a second stepping motor coupled to position a rack mounted to the yoke. As disclosed in this patent, the stepping motors for controlling the rotation of the main gear, and to control the movement of the yoke, are under the control of the electronic circuitry of the system. Such as arrangement may be incorporated in the latching arrangement of the present invention, so as to ensure that each cycle of printing postage is properly accounted in the electronic accounting registers of the postage meter.

For this purpose, a stepping motor 120 carries a pinion gear 121 on the shaft 122 thereof as seen in FIGS. 3 and 5. The pinion 121 carries an offset pin 123 therein adaptable to engage an aperture 124 in a pivotable link 125, the link 125 being pivoted at the fixed axis 126. The pinion 121 controls the lateral movement of rack 130 by means of an intermediate gear 131, for controlling the step-wise movement of a yoke (not shown) as above noted, the rack 130 thereby being mounted to position such a yoke. The form of the gears 121 and 131 illustrated in FIG. 1 is described more fully in the specification of copending application Ser. No. 089,350 filed on Oct. 30, 1979 and assigned to the assignee of the present application, and is not material to the features of the present invention.

The other end of the link 125 beyond the fixed pivot 126 meshes in a slot 140 in the pivoted member 91. As above discussed, the arm 90 of this element is engageable with the release pin 80 of the detent 70 as best seen in FIG. 4. In this figure it is also seen that the member 91 is pivoted for rotation about a fixed axis 142.

As a further detail of the structure as above disclosed, the mass of the detent 70, together with counterbalance 150, is arranged to have its center of gravity approximately coincident with its center of rotation at 71, so that linear inertial loads will not dislodge it. This feature permits the arrangement to be stable, so that shock loads will not cause unlatching of the device.

OPERATION

In the position of the components illustrated in FIG. 4, the tooth 72 of the detent 70 engages the upper notch 75 of the latch 50, thereby holding the latch to its most clockwise position. This position is a released position, enabling the postal meter to print postage. In this position, the projection 60 on the arm 55 of the latch is thereby displaced from the projection 61 of the cam surface 62, so that the driven gear 31 (FIG. 3) may be driven counterclockwise as shown by arrow 170 (FIG. 4), for example, by drive gear 32 of a postal meter drive base.

Upon counterclockwise rotation of the drivengear 31, the stud 79 will, after a small angular displacement, engage the projection 78 of detent 70 to effect the clockwise movement of the detent 70, and the projection 44 of the cam surface on the hub 43 of the drive gear will engage the roller 45 of the latch, to effect the release of the latch as well as its counterclockwise movement. The coaction between the cam surface 44 and the roller 45 forces the latch projection 60 into engagement with the cam surface 47 but the cam projection 61 is positioned at this time such that it will have already passed under the projection 60, and as a consequence, further rotation of the drive gear 31 is not inhibited. As a result upon a continued rotation of the drive gear, the latch will now be positioned such that the detent 70, upon release by the stud 79, will be pulled by the spring 82 so that its tooth 72 engages the lower notch 76 of the latch. The resultant counterclockwise position of the latch will thereby be maintained by the action of the spring 82, even after the projection 44 passes the roller 45.

It will further be apparent that the leading edge of projection 61 of the cam surface 62, and the cooperating surface of the projection 60 of the latch 50 are generally radially directed with respect to the axis of the drive gear, such that the normal counterclockwise rotation of the drive gear, as indicated by the arrow 170, is inhibited only at one angular displacement of the drive gear 31. At this time, however, in the above-described sequence of operations the drive gear 31 is free to be rotated by the external gear 32 to complete a printing cycle, without being under further control of the latch 50. Upon completion of the printing cycle, however, since the latch 50 has been moved to its counterclockwise position, the engageable surfaces of the projection 60 and the projection 61 will positively inhibit any further counterclockwise rotation of the drive gear beyond the above-noted angular displacement, so that a new printing cycle cannot commence without a resetting of the latch.

As above discussed, the latch must not be reset for further operation of the postal meter unless the power supply to the accounting system of the meter has been normal and it is preferred that the resetting occur during the latter part of the printing cycle, after the accounting has been done. Assuming that this is the case, and that the printing wheels in the printing drum have been set, if necessary, and the yoke of the postal meter has been positioned to its home position, a new printing cycle can commence. It must be noted that selection, by means of rack 130, is independent of latch resetting, so that a number of selections, including none, may have been made between each latch resetting, and vice versa. The position shown in the drawings for the rack position is a "home" position between the selection and resetting positions. At the start of a new printing cycle, the stepping motor 120 will have stepped the rack 130, and hence the locking mechanism for the setting gears, to the home position, and at the same time the pin 123 of the pinion 121 will have rotated the link 125, which in turn will have rotated the lever 91 and its extension 90 to engage the release pin 80 of the detent 70, thereby forcing the tooth 72 out of engagement with the lower notch 76. Since the latch 50 is not at this time under the control of a positively acting cam surface projection, the spring 82 biases the latch in the clockwise direction, thereby rotating the latch 50 in the clockwise direction to move it to a position to enable the tooth 72 to engage the notch 75 again. In order to avoid movement of the latch 30 beyond the correct clockwise position, it is therefore apparent that a stop, such as the fixed stop 171, must be provided, as illustrated in FIG. 4. It is thereby apparent that referring to FIG. 4 the latch must have a clockwise bias, preferably from the spring 82 with a stop 171 positioned such that the latch 50 will be aligned with the tooth 72, that the cam surface 43 and arms of the latch are proportioned to enable alignment of the upper notch 75 of the latch with the tooth 72, and that the detent 70 be positively biased toward the latch, preferably by the helical spring 82. Further, since the latch is positively forced in the counterclockwise direction by the cam surface 44, the cam surface 44 cannot be positioned to force the latch in this direction until the projection 61 of the cam surface 47 has cleared the latching projection 60 of the latch. It is preferred that the detent 70 be similarly controlled, such that the tooth 72 has moved out of the notch 75 only just prior to the positive control of the latch 50 by the cam surface 44. The upper surface of the tooth 72 is inclined to minimize the force required on the detent release lever 90, for releasing the detent 70, since release of the detent with this direction of inclinaton of the tooth 72 is somewhat aided by the spring 82.

In accordance with the illustrated embodiment of the invention, it is preferred that the slot 105 of the preferably sheet metal plate 102 is positioned such that, at its extreme counterclockwise position the optical path will be blocked, (contrary to the alignment illustrated in FIG. 4) indicating to the control electronic system that a print cycle has been initiated and that accounting can be effected. At this time, it will no longer be possible to stop the printing cycle, even though power to the postage meter itself is lost. If power had been lost prior to this time, but following the reset of the latch from the earlier printing cycle, the current printing cycle can be continued to completion, but a new printing cycle cannot have commenced since the latch 50 will not have been reset. Therefore under such conditions, if the electronic system is restored and detects the optic path of the electro-optic coupler 100 to be in a blocked position, then it will be controlled to effect the accounting of the postage printing that must have occurred in the interim. On the other hand, if power to the accounting system is lost subsequent the blocking of the optical path in a given cycle, then the accounting will have already been finished, so that the electronic system upon restoration of power, need only effect a reset of the latch. The above discussed operation of the electro-optic coupler is preferred, in order to ensure fail-safe operation of the system.

If power for the accounting system has failed at about the same time that the latch is being reset after an accounting, if the latch does not in fact become reset, when the power is restored, the logic, seeing that the latch is still set could interpret this as indicating that another print cycle had taken place during the power failure when, in fact, it had not.

This problem can be solved by ensuring that the power supply in the meter itself provides enough power to the stepping motor 120 such that, once the motor has been pulsed to reset the latch, this operation will be carried to completion. Since, unlike meter rotation, this operation is strictly internal to the meter, such energy requirements can be precalculated when the meter is designed. In this regard, in many applications it may be necessary for the electronic system to be able to sense when the roller 45 is clear of the projection 44, for example, by means of a switch 186 following the cam surface 43 so that an attempt to reset the latch is not made prematurely, thereby wasting stored power.

The electrical control system for resetting the latch may be designed in many different ways. For example, as illustrated in FIG. 6, the postal meter may be comprised of a micro-computer system 180 of the type disclosed, for example, in U.S. Pat. No. 3,978,457, having programmed software or firmware in read-only memories 181 and registers 182, for example, ascending and/or descending registers, for storing postal data. A keyboard 183 may be coupled to the micro-computer system to enable the entry of postage data for printing, and a display 184 may be provided for displaying, for example, current postage to be printed.

A suitable electric power source (not shown) is, of course, connected to this system in the conventional manner.

The printing system 185, for example, of the type generally disclosed in U.S. Pat. No. 4,050,374, includes the print wheel selecting stepping motor 120 as above discussed, as well as the detector 100 for indicating the position of the latch 70. The printing system may further be provided with the switch 186, as discussed above, adapted to follow the cam surface 43 to avoid premature resetting of the latch.

As further discussed above, when the print wheels (not shown) have been set (if necessary) and the preconditions for a print cycle have been met in the electrical systens, and the stepping motor 120 is stepped to a position whereby the latch is reset due to the release of the detent 70, the latch is enabled to move to the position indicated in FIG. 4, whereby the projection 60 had disengaged the projection 61 and the drive gear 31 can rotate. Upon the tripping of the print lever 28 of FIG. 2, a printing cycle may now be initiated, with the printing drum rotating under the control of the drive gear 31. After a given angular displacement of the drive wheel, this movement is signaled to the micro-computers system by means of the detector 100, whereby the completion of the printing cycle is independent of the postal meter, and an accounting operation may be completed in the micro-computer system. Further printing cycles will of course be prevented until the latch is again reset to move the projection 60 out of the path of the cam projection 61. The loss of power, sensed by a suitable system in the micro-computer, so that sensing of the set position of the latch followed by loss of power prior to the resetting of the latch and an accounting operating which should have occurred, and the subsequent resetting of the latch. This sequence is not followed, however, if the switch 186 detects the positioning of the roller 45 on the cam surface projection 44, at which time the latch is of course positively held in the counterclockwise position and resetting could not occur.

In the system in accordance with the invention, it should be noted that the opto coupler 100 produces a single transition upon the counterclockwise movement of the latching lever 50 as a result of the positive driving force from cam surface projection 44. It is therefore evident that the stud 79 must be positioned to withdraw the detent at an angular displacement at least shortly before the engagement of the roller 45 on the cam surface projection 44. The resultant signal from the optic coupler 100 provides information to the micro-computer that the printing cycle has irreversibly commenced, at least with such assurance that an accounting operation should be performed, for example, that the one or more registers in the accounting system should be brought up to date with the printing of postage during the current printing cycle. The cam surface 44 must have adequate length that the detent 70 will have been released by the stud 79, to effect the engagement of the 72 with the lower notch 76. It is preferred that the positive action of the cam surface 44 be released as soon as this fact can be assured, and at least before the electronic accounting has in fact occurred. If necessary, suitable delays must be provided in the accounting system to assure that the resetting movement of the lever 90 cannot occur before the disengagement of the roller 45 from the cam projection 44. Following this release, and upon completion of the accounting as above discussed, the stepping motor 120, under control of pulses received from the accounting system, will drive the lever 90 to again release the detent 70, so that the spring 82 drives the lever 50 in a clockwise direction to draw the arm 55 against the stop 171, i.e. out of a position that would inhibit the next printing cycle.

In this regard, it is to be noted that the program of the accounting system may be readily designed to provide the stepping to the motor 120, to effect the necessary rotation of the lever 125.

Since, as above discussed, the stepping motor 120 also serves other functions, the slot 124 in the lever 125 may have an extended circular shape at one end thereof such that the lever 125 is held at a fixed position during these other operations, at which time the lever 90 is held in a fixed position that does not interfere with the movement of the detent 70. The pin 123 thereby effects rotation of the lever 125 only when it engages the straight end of the slot 124, in the illustrated embodiment of the invention.

The system of the invention thereby guarantees that every printing operation in an electric postage meter is accounted for independently of intervening power failure, by providing an arrangement in which the action of printing sets a latch which further printing cycles do not reset, and wherein a reset operation can only be effected by the proper actuation of the electronic controls which also perform the necessary accounting in the equipment.

While the invention has been disclosed and described with reference with a single embodiment, it will be apparent that variations therein are possible. For example, although the latch is shown as being reset by the action of the bank select stepping motor, it is apparent that such resetting can alternately be effected by, for example, a solenoid operated by the same control electronics. Further, the latch as disclosed above acts directly on the print rotating parts of the printing mechanism. Alternately, the latch could be operative on any other element that is effective in preventing drum rotation, such as a shutter or shutter latch mechanism. It is therefore intended in the following claims to cover each such variation and modification as falls within the true spirit and scope of the invention.

What is claimed is:

1. In a postage meter having a settable printing mechanism, a drive input mounted to receive mechanical input energy for driving said printing mechanism through printing cycles, said drive input having a home position that it assumes following each printing cycle, and an electronic accounting system including a register for storing data related to postage printed thereby, said accounting system being coupled to said printing mechanism for storing in said register a value corresponding to the setting of said printing mechanism for each printing cycle; the improvement comprising a mechanical latch mounted to have a first stable position blocking said drive input from initial movement away from said home position, and a second stable position in which said drive input is unblocked to be continuously operable to drive said printing mechanism through a printing cycle, said drive input having means setting said mechanical latch at a determined degree of movement following initiation of a printing cycle, and further comprising means responsive to storage in said register during a printing cycle of the setting value of said printing mechanism for setting said latch to said second stable position.

2. The postage meter of claim 1 wherein said drive input comprises a gear assembly including a drive gear, said settable printing mechanism having a shaft coupled to said gear, whereby said home position corresponds to a given angular displacement of said gear, said gear assembly further having a cam surface with a stopping cam, said latch having an arm engaging said stopping cam in the home position of said gear.

3. The postage meter of claim 2 further comprising a detent having a tooth, said latch having first and second notches aligned with said tooth at said first and second positions respectively, and first spring biasing means urging said tooth toward said notches.

4. The postage meter of claim 3 wherin said spring biasing means comprises a spring extending between said detent and said latch.

5. The postage meter of claim 3 comprising a projection on said gear assembly positioned to engage said detent at a determined angular displacement of said gear for drawing said tooth away from said notches.

6. The postage meter of claim 5 wherein said gear assembly further has a cam surface engageable with said latch for positively driving said latch to its first position, said cam surface being positioned so that movement of said latch occurs at a time when said detent is not in engagement with said latch.

7. The postage meter of claim 6 wherein said means responsive to said storage in said register comprises a lever positioned to disengage said tooth from said second notch, and second spring means coupled to move said latch to align said first notch with said tooth.

8. The postal meter of claim 7 where said second spring means comprises a spring connected between said detent and said mechanical latch and positioned to urge said tooth into said notches.

9. The postal meter of claim 1 further comprising a light source spaced from a light detector, said latch having an arm extending in cooperative relationship between said light source and light detector for enabling said light detector to produce output signals responsive to the position of said latch.

10. In a postage meter having a settable printing mechanism, a drive input mounted to receive mechanical input energy for driving said printing mechanism through printing cycles, said drive input having a home position that it assumes following each printing cycle, an electronic accounting system including a register for storing data related to postage printed thereby, said accounting system being coupled to said printing mechanism for storing in said register a value corresponding to the setting of said printing mechanism for each printing cycle; the improvement wherein said drive input comprises a gear assembly including a drive gear coupled to rotate said printing mechanism, a pivoted lever having first and second arms and a first and second adjacent notches, a pivoted detent having a tooth selectively alignable with said first and second notches, spring means extending between said lever and said detent urging said tooth selectively into one of said notches, said gear assembly having a first cam surface cooperatively positioned with respect to said first arm to hold said gear assembly at a given angular displacement when said tooth engages said first notch, a second cam surface positioned to engage said detent for driving said tooth momentarily out of said second notch, and a third cam surface for positively driving said second arm to align said second notch with said tooth, said spring means being positioned to align said first notch with said tooth upon withdrawal of said tooth from said second notch.

11. The postage meter of claim 10 further comprising a light source spaced from a light detector, said lever having a projection operatively extending between said light source and light detector for enabling the producing by said light detector of an electrical signal corresponding to the position of said lever.

* * * * *

UNITED STATES PATENT AND TRADEMARK OFFICE

CERTIFICATE OF CORRECTION

PATENT NO. : 4,259,902

DATED : April 7, 1981

INVENTOR(S) : Alton B. Eckert, Jr. and Robert B. McFiggans

It is certified that error appears in the above-identified patent and that said Letters Patent are hereby corrected as shown below:

Column 3, line 26, please change "dentent" to --detent--

Column 8, line 50, please change "inclinaton" to --inclination--

Signed and Sealed this

Second Day of November 1982

[SEAL]

*Attest:*

GERALD J. MOSSINGHOFF

*Attesting Officer*

*Commissioner of Patents and Trademarks*